US007104483B2

(12) United States Patent
D'Agnolo

(10) Patent No.: US 7,104,483 B2
(45) Date of Patent: Sep. 12, 2006

(54) METHOD AND TENSIONING DEVICE FOR STABILIZING AND REGULATING THE TENSION OF THREAD BEING UNWOUND FROM BOBBINS

(75) Inventor: Armando D'Agnolo, Porcia (IT)

(73) Assignee: Savio Macchine Tessili, S.p.A, Pordenone (IT)

( * ) Notice: Subject to any disclaimer, the term of this patent is extended or adjusted under 35 U.S.C. 154(b) by 4 days.

(21) Appl. No.: 10/878,962

(22) Filed: Jun. 28, 2004

(65) Prior Publication Data

US 2005/0011984 A1 Jan. 20, 2005

(30) Foreign Application Priority Data

Jul. 1, 2003 (IT) ..... UD2003A 000143

(51) Int. Cl.
*B65H 59/16* (2006.01)
*D01H 13/10* (2006.01)

(52) U.S. Cl. ..... 242/155 R; 242/156.2; 242/419.9; 57/58.86

(58) Field of Classification Search ..... 226/195; 242/593, 419.9, 419.8, 566, 155 R, 155 BW, 242/156.2; 57/58.83, 116, 58.86
See application file for complete search history.

(56) References Cited

U.S. PATENT DOCUMENTS

| | | | | |
|---|---|---|---|---|
| 1,620,558 | A * | 3/1927 | Joyce | 242/156.2 |
| 2,314,070 | A * | 3/1943 | Bogoslowsky | 242/155 R |
| 3,153,894 | A * | 10/1964 | Kreuschmer | 57/58.76 |
| 3,165,882 | A * | 1/1965 | Kreuschmer | 57/58.83 |
| 4,487,009 | A * | 12/1984 | Winkelmann | 57/58.86 |

FOREIGN PATENT DOCUMENTS

| | | |
|---|---|---|
| DE | 11 84 861 B | 12/1964 |
| DE | 11 88 484 B | 3/1965 |
| GB | 1038504 A | 8/1966 |

OTHER PUBLICATIONS

European Search Report.

* cited by examiner

*Primary Examiner*—Kathy Matecki
*Assistant Examiner*—William E. Dondero

(74) *Attorney, Agent, or Firm*—Hedman & Costigan; James V. Costigan

(57) ABSTRACT

Method and relevant device for stabilizing and regulating the tension of a thread (16) being unwound from a bobbin (18). The method envisages the addition to the unwinding tension ($t_d$), of a resistant tension automatically variable in relation to the intensity of the unwinding tension ($t_d$).

15 Claims, 5 Drawing Sheets

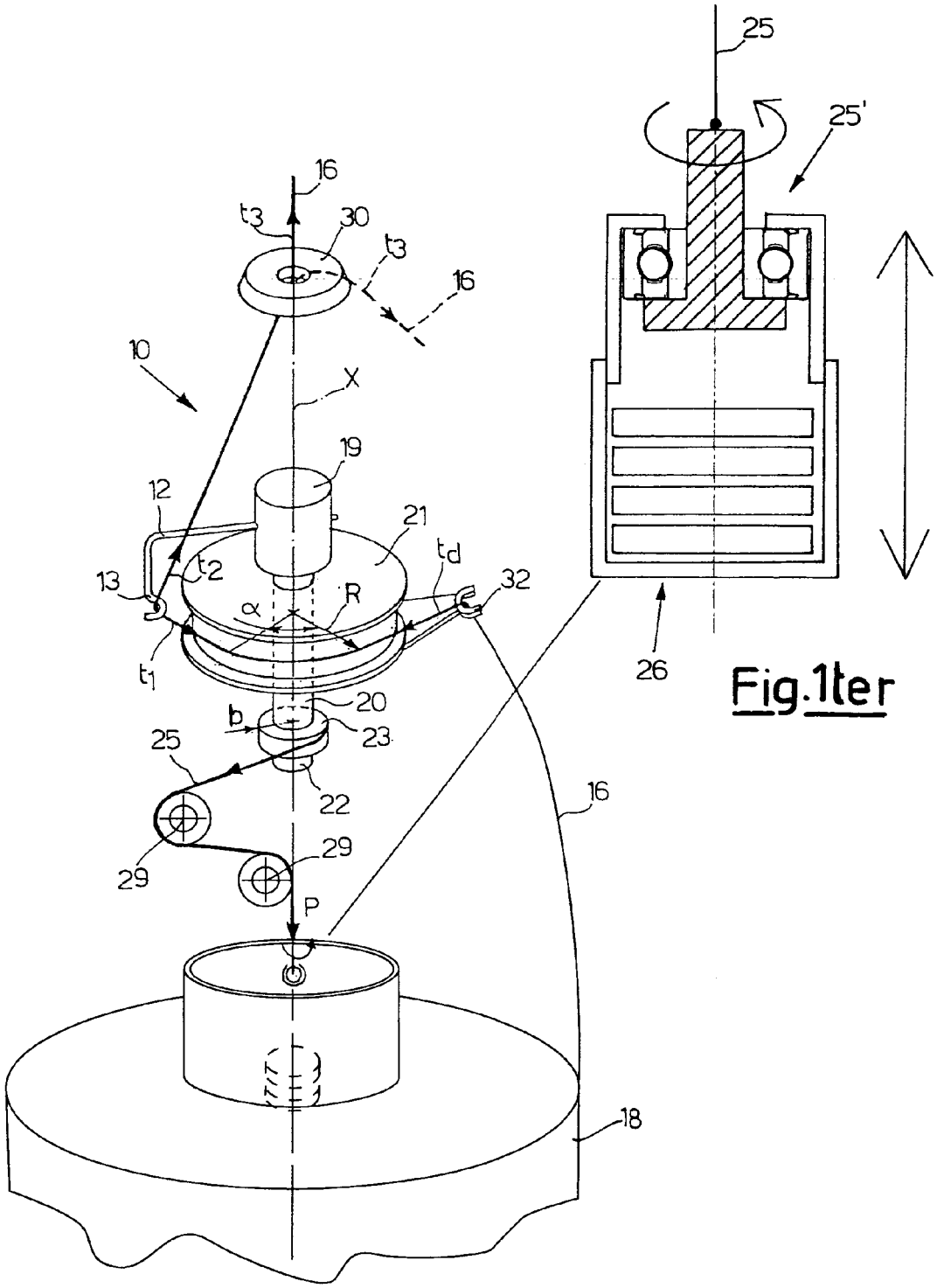
Fig.1ter
Fig.1bis

METHOD AND TENSIONING DEVICE FOR STABILIZING AND REGULATING THE TENSION OF THREAD BEING UNWOUND FROM BOBBINS

APPLICATION FIELD

The present invention relates to the method and relevant tensioning device for stabilizing and regulating the tension of thread being unwound from a bobbin or "cop".

Thread refers to any kind of thread or yarn, obtained from natural, artificial, chemical fibers or mixed fibers. The method and tensioning device according to the present invention, is particularly, but not exclusively, used in four-twisting twisters, or in other textile equipment wherein the thread bobbins are axially unwound (in a "défilé" manner) and at a relatively low rate, both when the unwinding is direct, and when it is effected by means of a reeling machine.

STATE OF THE ART

It is well known that in thread unwinding machines, for example in four-twisting twisters, as described in Italian patent EP 1007773 granted to the Applicant, the thread is axially unwound from a thread bobbin, with remarkable tension variations of the unwound thread.

This tension variation of the unwound thread is due to the gradual reduction of the bobbin diameter and to the shifting of the thread along its unwinding generatrix.

These tension variations are particularly high when the bobbin is substantially cylindrically shaped and, more generally, when the unwinding is effected using a reeling machine, of the known type, which rotates as a result of the action of the unwinding thread.

It is known that tensioning devices are normally used, which brake the moving yarn, thus increasing its tension, in order to give the yarn an adequate tension level and to stabilize the latter in different textile processes, in particular in yarn twisting process.

In the state of the art, e.g. from GB 1.038.504 and DE 1184681, devices for regulating the tension of the double twisting spindles are disclosed.

Said devices are able to add an additional tension but they are unable to counterbalance the variation of the unwinding tension and to give to the exit of the unwinding device a substantially constant tension.

These known tensioning devices generally include a thread tension mechanism consisting of two opposed surfaces which are pushed against each other by weights or springs, between which the thread is passed, such as, for example: washer yarn-braking, charged with weights or springs; piston-tensioner charged with a spring; ball-tensioner.

In recent years, a tensioning device of the so-called "magnetic" type has been developed, which differs from those mentioned above as in this case the tension on the yarn is created by resistance to the rotation of a small wheel on which the yarn is wound and which is slowed down by magnetic hysteresis.

Although both mechanical and magnetic tensioning devices produce an increase in the yarn tension, they do not effectively stabilize the tension itself due to the fact that, as they add a substantially constant value to the tension, they tend to maintain yarn tension irregularities on the yarn tension, which are present at the inlet of the same tensioning devices.

The tensioning devices known in the state of the art are not suitable to ensure a substantially constant tension and they do not meet the requirements of four-twisting spindles, where it is necessary a substantial constant tension in the thread unwound from the feed package. Reference is made, for instance, to a four-twisting spindle according to patent EP 1007773.

These drawbacks have negative consequences on the yarn tension in four-twisting twisters where the known tensioning device is installed, which leads to irregularity and uncontrollability of the balloons, mainly of the descending balloon formed around the packaging container. The operation of a four-twisting spindle requires the formation of two balloons, one inside and the other outside.

For a good operation, the spindle of the four-twisting device requests that every balloons must be stabilized. With reference to the spindle according to the cited patent EP1007773, the rising outer balloon is provided with a reserve pulley, similarly to the traditional double-twisting, while the inner downward balloon does not have space to place a reserve pulley of the thread.

Lacking of a balancing device that gives a substantial constant tension of feed thread, the inner balloon would vary continuously its shape and would interfere with the outer balloon, making the four-twisting spindle not operable.

An objective of the present invention is to provide a balancing device which guarantees the stabilization of the unwound yarn tension and which also allows the consequent regularization and stabilization of the yarn tension downstream of the tensioning device.

The Applicant has studied, experimented and created the present invention, in order to overcome the drawbacks of the known art, to achieve this and other objectives and to obtain further advantages.

INVENTION DISCLOSURE

The present invention is disclosed and characterized in the main claim.

The secondary claims relate to other characteristics of the present invention or variations of the main solution idea.

In accordance with the above objective, the method and tensioning device according to the present invention, envisages the addition of a resistant tension to the yarn unwinding tension, generated by means outside the device, whose amount is automatically variable in relation to the variations of said unwinding tension. In this way, a substantially constant tension on the yarn is obtained, downstream of the device itself.

The amount of resistant tension which is added is generated and controlled by tensioning devices comprising an arm element which oscillates around a rotational axis and which is suitable for winding the thread, within a variable range, onto a cylindrical body, a pulley, for example, coaxial with said rotational axis.

The above-mentioned arm element is subjected to both the unwinding tension of the yarn, increased by the resistant tension due to the at least partial winding of the yarn itself onto said cylindrical body, and to the action of a contrasting force which opposes the yarn unwinding tension, increased by said resistant tension.

According to a characteristic of the present invention, said contrasting force is substantially constant during the entire oscillating range of the arm element and is generated, for example, by a spring or a weight whose value can be regulated.

The arm element is integral with a cylindrical element, consisting, for example, of a small pulley which can rotate around the rotational axis and connected to a flexible hauling element, on which a constant load is applied, which represents said substantially constant contrasting force.

The resistant tension added to the unwinding tension is generated by the friction of the yarn which runs on the cylindrical surface of the cylindrical body, according to the known law of physics $$\Delta t = t_d(e^{\mu\alpha} - 1)$$

wherein $\Delta t$ is the tension increase;

$t_d$ is the unwinding tension, or, more precisely, the yarn tension in the contact point with the cylindrical body;

$\alpha$ is the contact angle of the yarn with the cylindrical body;

$\mu$ is the friction coefficient between the running yarn and the cylindrical body, and therefore depends on the type of yarn, the material and the finishing degree of the cylindrical body.

For a certain yarn, surface and finishing degree of the cylindrical body, $\mu$ is a constant.

In addition to four-twisting (two plus two) twisters, the present invention can also be applied in other twisting systems, for example those called "cabling" or "tyre cord", in knitwear, or others, and, more generally in all textile processes where bobbins are unwound, both when the unwinding is direct and also when effected by means of a reeling machine.

EXPLANATION OF THE DRAWINGS

These and other characteristics of the invention will appear evident from the following description of some preferential embodiments, provided for illustrative and non-limiting purposes, with reference to the enclosed drawings wherein:

FIG. 1 is a schematic representation of the principle on which a tensioning device is based, according to the present invention, whereas FIG. 1bis and 1ter show a preferential realization thereof, when the tensioning force is applied by weights;

DESCRIPTION OF SOME PREFERENTIAL EMBODIMENTS

Figure 1:
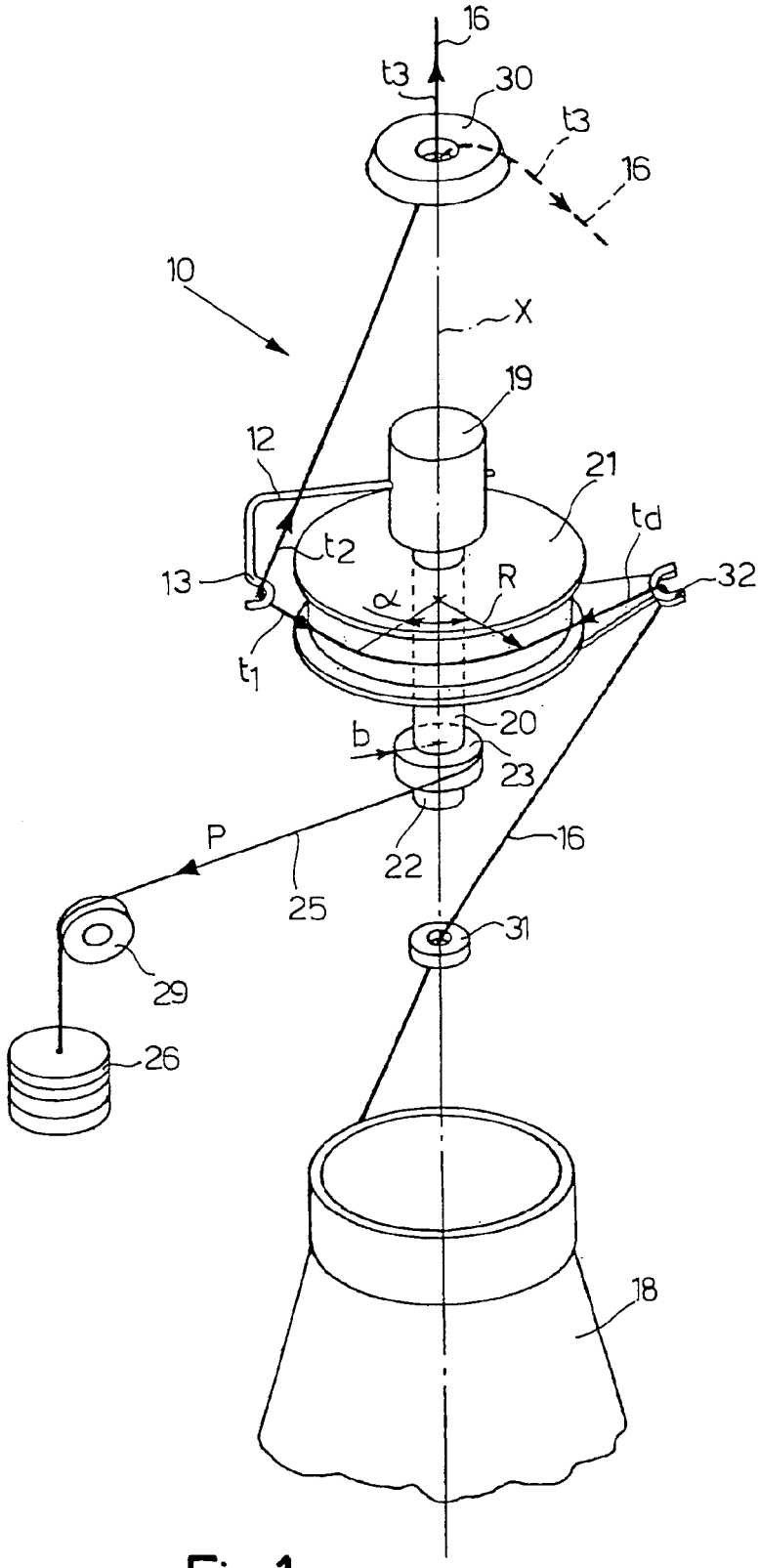
Figure 2:
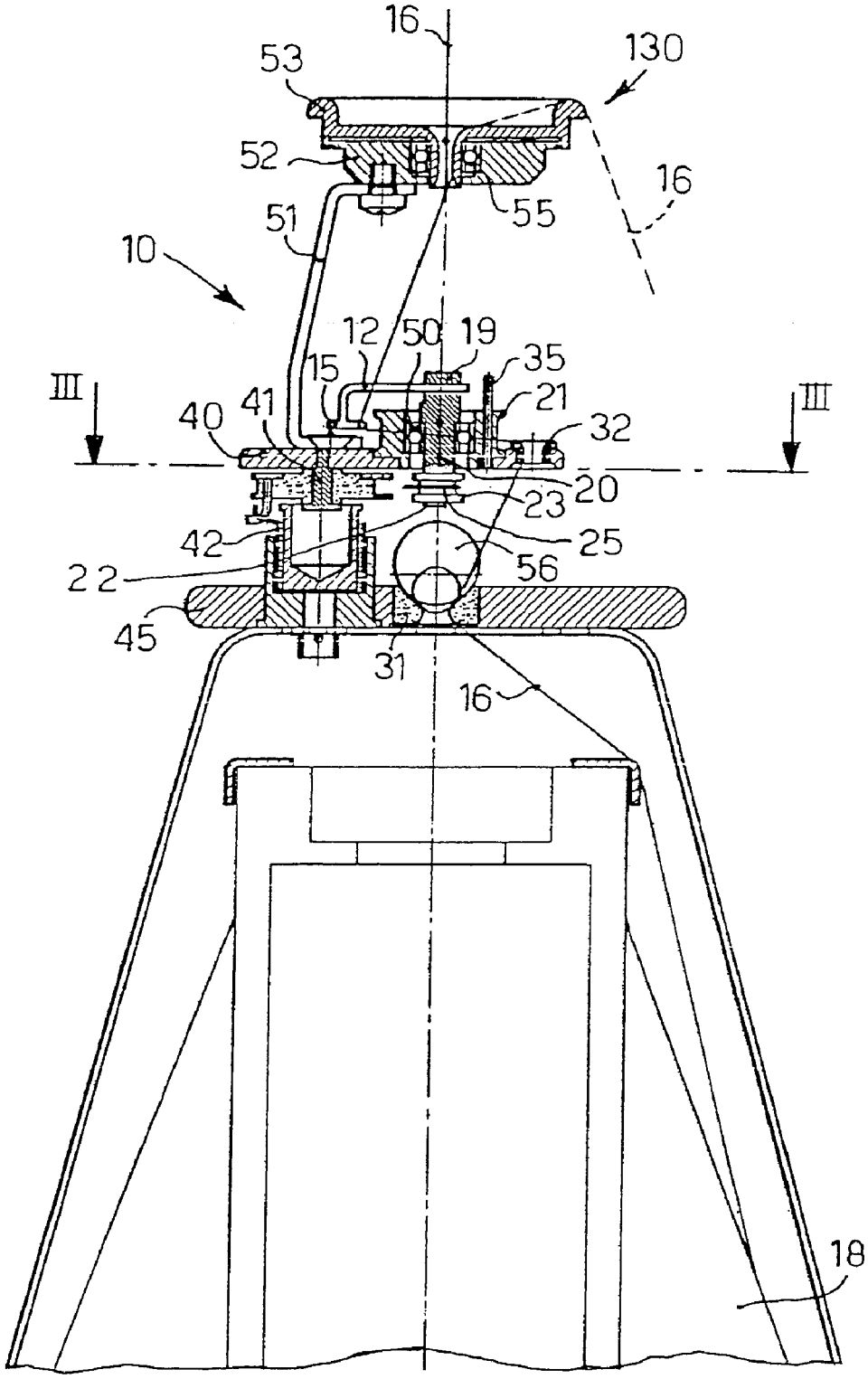
FIG. 2 is a longitudinal section of a tensioning device according to the present invention, in a first embodiment, with direct unwinding.
Figure 5:
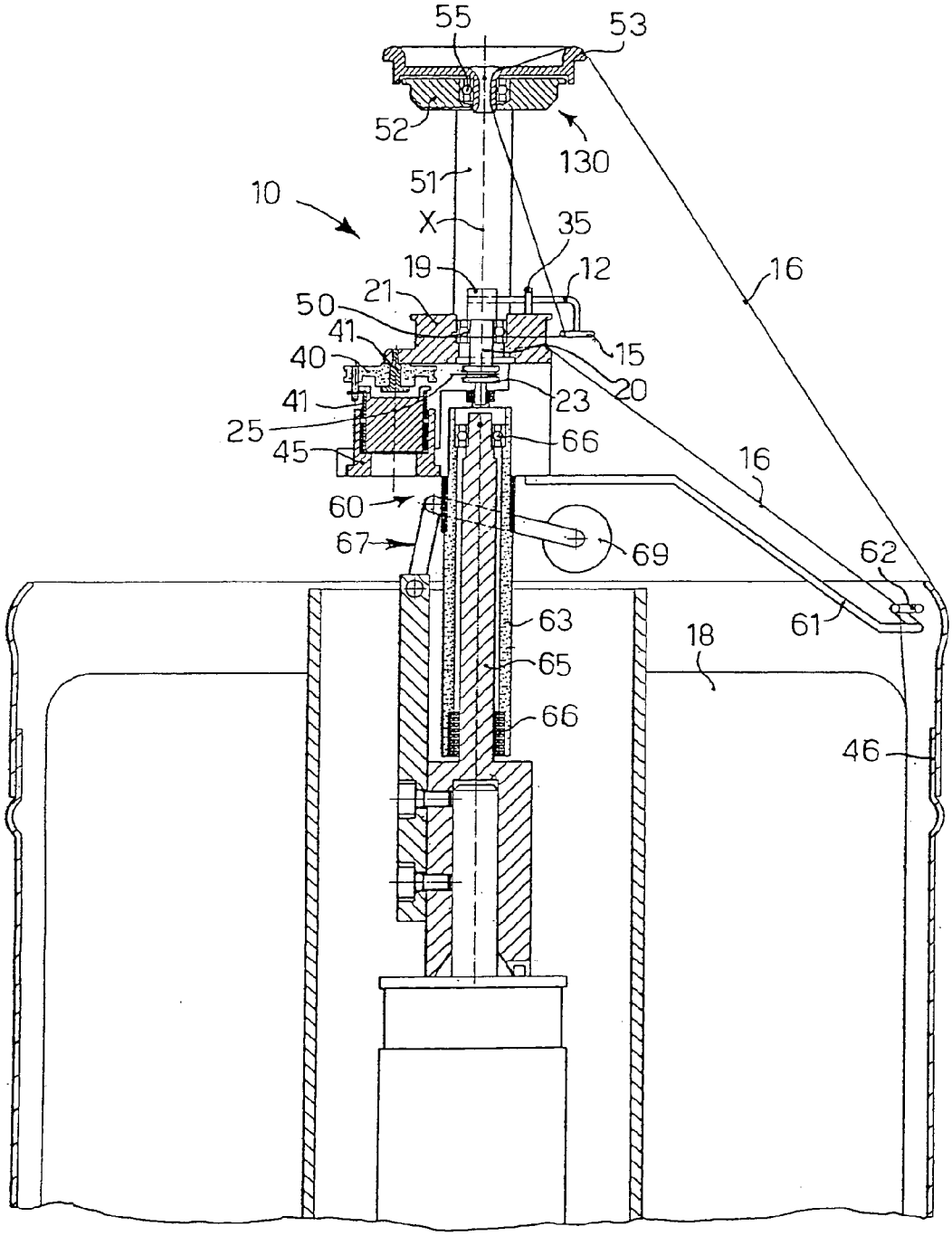
FIG. 5 is a longitudinal section of a tensioning device according to the present invention by means of a reeling machine.

With reference to FIG. 1, a tensioning device 10 according to the present invention, substantially comprises a radial arm 12, oscillating around a rotational axis X and including an end 13, shaped as a hook or an eyelet 15 shown in the next FIGS. 2 and 5, for example made of ceramic or other material having a low friction coefficient, to guide a yarn 16 which is unwound from a bobbin 18, coaxial to the rotational axis X.

The radial arm 12 is fixed to an end 19 of a shaft 20 coaxial with the rotational axis X and free to rotate with respect to a winding pulley 21, also coaxial to the rotational axis X. The winding pulley 21 has a fixed radius R.

A small pulley 23 is wedged at the other end 22 of the shaft 20, on which a thin cable 25 is fixed, to enable the latter to be freely wound onto the peripheral surface of the small pulley 23. The thin cable 25 can be substituted with a rope, a small belt or analogous flexible connecting body. The small pulley 23 has a fixed radius b.

Moreover, according to a characteristic aspect of the present invention, a constant traction force P is applied to the cable 25, obtained, for example, by means of a weight 26, arranged vertically, and a counter-pulley 29.

A first ceramic- or chromium-plated metal—thread guide ring 30, is coaxially positioned with the rotational axis X, above the shaft 20, whereas a second thread guide ring 31, again in ceramic or in a chromium-plated metal, is positioned coaxially with the rotational axis X, between the shaft 20 and the bobbin 18.

A thread guide element 32 is fixed outside the winding pulley 21 so that it lies on a circumferential plane of the latter.

The forces operating on the oscillating arm 12, as shown in FIG. 1, are:

$t_1$, which is the tension on the thread 16 at the inlet of the hook 13 of the oscillating arm 12, i.e. at the inlet of the latter, is oriented according to the tangent of the winding pulley 21, and is equal to $t_d + \Delta t$;

$t_1$, which is the tension on the thread 16 at the outlet of the hook 13 of the oscillating arm 12, i.e. at the outlet of the latter, and oriented towards the rotational axis X and the centre of the thread guide ring 30;

P, which is the resisting force applied to the cable 25.

The equilibrium with the rotation of the oscillating arm 12 (with respect to its axis X), under steady or almost steady conditions, regardless of the mechanical frictions, is $$t_1 \cdot R = P \cdot b$$

as the tension $t_2$ does not give components due to the fact that it is directed towards the rotational axis X. Therefore, $$t_1 = b/R \cdot P$$

which means that, when the haulage force P applied on the cable 25 and therefore on the small pulley 23, is kept constant for the whole winding angle envisaged on the winding pulley 21, $t_1$ will tend to remain constant, as it is obliged to remain at such.

The oscillating arm 12 will consequently rotate in one direction or another, in order to maintain the equilibrium between the unwinding tension of the thread 16 and the resisting moment P·b applied to the small pulley 23, so as to create, in relation to the actual unwinding tension of the bobbin 18, the amount of resisting tension $\Delta t$ necessary for maintaining the inlet tension at the hook 13 constant.

If $t_1$ is kept constant however, $t_2$ at the outlet of the hook 13 will also be constant, as:

$$t_2 = t_1 \cdot e^{\mu_2 \alpha_2}$$

wherein:

$\alpha_2$ is the contact angle of the thread 16 with the hook 13 which is constant;

$\mu_2$ is the friction coefficient between the thread 16 and the hook 13, also constant for a given thread 16 and a given material of the hook 13.

Furthermore, under the same conditions, the tension $t_3$ will be constant, at the outlet of the upper thread guide ring 30, both when the thread 16 is directed upwards, along the rotational axis X, and also when the thread 16 is directed downwards to form a possible descending balloon for a four-twisting procedure. In all cases we have:

$$t_3=t_d\cdot e^{\mu\alpha}\cdot e^{\mu_2\alpha_2}\cdot e^{\mu_3\alpha_3}=b/R\cdot Pe^{\mu\alpha+\mu_2\alpha_2+\mu_3\alpha_3}$$

wherein:

$\alpha_3$ and $\mu_3$ are the contact angle of the thread 16 with the upper thread guide 30 and the friction coefficient between the thread 16 and the upper thread guide 30, respectively.

Tests and experiences of the Applicant have demonstrated that the device 10 can be advantageously used at rates of at least up to 300 m/min and also up to 450 m/min, with direct unwinding and at least up to 150 m/min and also up to 180 m/min for unwinding with a reeling device.

In addition to stabilizing the tension of the thread 16, the device 10 also allows the tension level requested by the downstream process to be regulated. By varying the value of the load P, the working tension can in fact be proportionally modified.

In practice, however, also the unwinding tension $t_d$ can be increased by means of suitable braking systems, in order to obtain certain levels of working tension.

In the FIGS. 1bis and 1ter a preferential realization of the balancing device is shown, where the tensioning force is applied by weights.

It has to be considered that the tensioning device 10 rotates together with the balloons of the thread 16, while the feed package is steady.

In the case of the four-twisting spindles, the inner of the bobbin 18 of doubled thread is available. From pulley 23 and through two counter-pulleys 29, the cable 25 reverts in an axial position within the spindle. The weight 26 connected to it is so moving vertically into the tube of the bobbin 18.

According to a realization preferred by the invention, a joint 25' is interposed on the cable 25 that does not allow to transmit to the weight 26 the rotating movement that affects the tensioning device 10.

In FIG. 1ter, the joint 25' shown is made of a ball-bearing.

The weights 26 are therefore on the axis of the twisting spindle and are not affected by centrifugal force.

The number of the wrapping turns of the thread 16 around the pulley 21 depends on the stroke available for the weights, while the quantity of the weights 26 depends on the size of the pulleys 21 and 23, moreover on the desired tension on the thread 16.

It has been noted that with the realization of FIG. 1bis, the force expended with weight 26 results are constant and independent based on the extent of the angle $\alpha$ of contact between thread 16 and pulley 21.

As an alternative to the use of the weight 26, the constant of the resistant force P can be obtained by the use of suitably applied springs and with systems which compensate the linear variation of the force for the variation, under operating conditions, in the length or angle of said springs.

Figure 3:
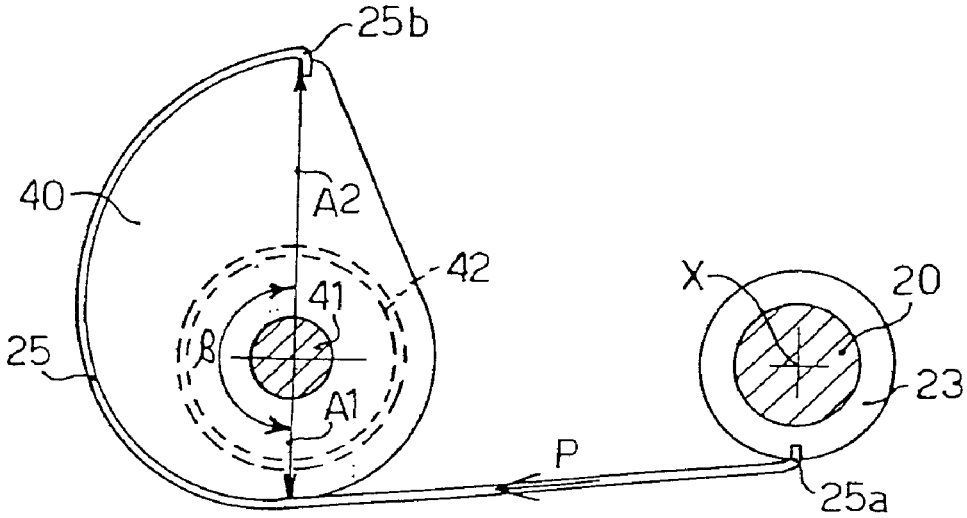
FIG. 3 is a section along the line III—III of FIG. 2, with the device according to the present invention, in a first operating condition.
Figure 4:
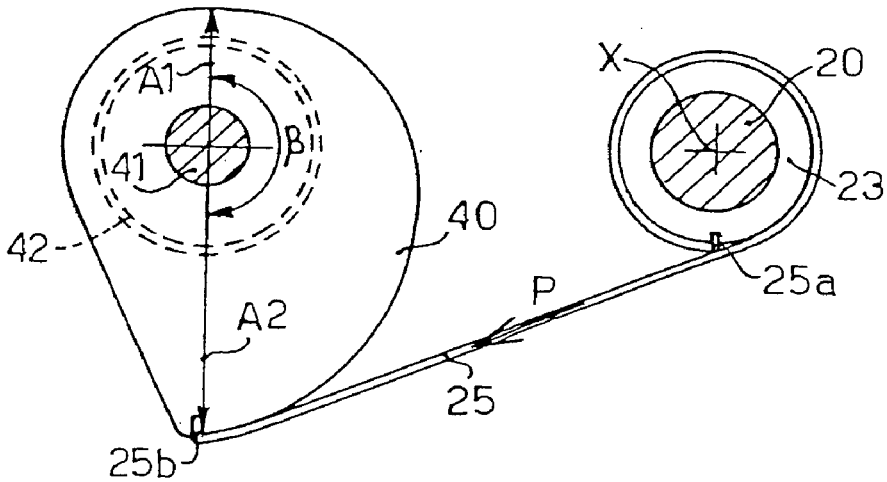
FIG. 4 represents the same elements of FIG. 3, but in a second operating condition.

Among the many possible solutions, one is illustrated as an example, with reference to FIGS. 2, 3 and 4.

In the present invention, the cable 25 has one of its ends, 25*a* (FIG. 3 and 4) integral with the small pulley 23, and another end 25*b* integral with the small pulley 23, and another end 25*b* integral with a cam 40, which can rotate on a hinge 41, parallel to the rotational axis X. The cam 40 develops in a substantially linear mode with an angle $\beta$, passing from a radius A1 to a radius A2, and the amount of this development is substantially equal to the circumference of the pulley 23.

The Head of a spring 42 of the flexional type, with a high number of coils (20, for example) is fixed to the cam 40, and arranged coaxially with the hinge 41 (FIG. 2, 3 and 4). The other end of the spring 42 is fixed to a supporting plate 45 (FIG. 2) of the device 10.

In this solution, the spring 42 acts on the same radial arm 12 through the cam 40 and the small cable 25, which partially coils around the same and partially around the small pulley 23. The cam 40, as the spring 42, when operating, linearly increases its charge, also proportionally increases the distance of the cable 25 from the axis of the hinge 41. In this way, the tension P on the cable 25 is always the same, for any angular position of the cam 40 and the radial arm 12.

If, for example, the envisaged working angle of the radial arm 12 is 360°, the angle $\beta$ of the cam 40 and therefore of the spring 42 is 180°, the spring 42 is precharged for 180°, and the radius A2 is equal to the double of the radius A1, as the spring 42 doubles its charge, the cam 40 will therefore accomplish the linear doubling of the cable distance from the axis of the hinge 41 for 180° of its development, ensuring the constancy of the charge P for the whole 360° rotation of the radial arm 12, to which an analogous rotation of the small shaft 20 corresponds, as shown in FIGS. 3 and 4.

A stop pin 35 (FIG. 2) is vertically placed on the upper part of the winding pulley 21, to limit the rotation of the radial arm 12 and prevent the spring 42 discharging over a certain value. The latter can be directly fixed on the winding pulley 21, in which case the rotation angle of the radial arm 12 can be of a maximum of 360°, or a little less, or mounted on an element which can twist for a certain arc, around the rotational axis X with respect to the winding pulley 21, in which case the rotation angle of the radial arm 12 can be over 360°.

According to the embodiment of the device 10 shown in FIG. 2, the pulley 21 is fixed to the support plate 45, which, in turn, is fastened to a fixed containment structure 46, or container, placed coaxially with the bobbin 18. A ball bearing 50 is interposed between the pulley 21 and small shaft 20.

Moreover, a lateral upright element 51 is indirectly fixed to the supporting plate 45 and supports a thread guide group 130, consisting of a fixed base 52, a rotating disk 53, with in between a ball bearing 55. The thread guide group 130 has the same function as the thread guide ring 30.

A pre-charge ball 56 is placed above the second thread guide ring 31, in order to vary the value of the unwinding tension $t_d$.

According to another embodiment shown in FIG. 5, the device 10 is mounted on a reeling machine 60, rotating around the rotational axis X. The reeling machine 60 includes an arm 61 equipped, at one end, with a thread guide 62.

In this case, the supporting plate 45, together with the structure mounted on it, which is analogous to that previously described with reference to FIG. 2, rotates together with the reeling machine 60 with respect to the container 46 placed around the bobbin 18.

The supporting plate 45 is integral with a short tube 63 mounted so that can twist around a fixed pin 65, with in between the ball bearing 66.

A brake of known type 67, equipped with a weight 69 for the regulation of the unwinding tension $t_d$, is associated to the short tube 63.

For all the above, it is clear that the method according to the present invention, for stabilizing and regulating the tension of a thread being unwound from a bobbin, envisages that an amount of tension Δt, automatically variable, is added to the thread unwinding tension $t_d$ applied by a body external to the device according to the invention, so as to have, downstream the device itself, a constant tension on the thread.

It is clear, however, that the device 10 herein described, which has been applied, for illustrative purposes, to a four-twisting twister, can be modified and/or parts can be added to it, or can be adapted for other applications, without being excluded from the scope of the present invention. For example, the device according to the present invention can be used for other types of textile machines.

It is also clear that, even if the invention has been described making reference to specific examples, any person skilled in the field can surely found other equivalent forms of tensioning devices, all of them included within the scope of the present invention.

The invention claimed is:

1. Method for stabilizing and regulating the tension of a thread (16) being unwound from a bobbin (18), which comprises adding an unwinding tension ($t_d$) to a resistant tension (Δt) on said thread, said resistant tension being automatically varied in relation to the intensity of said unwinding tension ($t_d$) so that the tension ($t_2$) of the thread (16) at the exit from the tensioning device (10) is substantially constant as the thread is wrapped at a wrapping angle (α) which is varied wherein said resistant tension (Δt) is generated and controlled by an arm element (12), oscillating around a rotational axis (X), suitable to make said thread (16) to wind, for a variable range of the wrapping angle (α), on a cylindrical body (21), coaxial to said rotational axis (X) said arm element (12) being subjected to the action of said unwinding tension ($t_d$) of said thread (16), increased by said resistant tension (Δt), and to the action of a contrasting force (P) which opposes an unwinding tension ($t_d$), increased by said resistant tension (Δt).

2. The method according to claim 1, wherein said contrasting force (P) is substantially constant for the entire oscillating range of said arm element (12), around said rotation axis (X).

3. The method according to claim 1 or 2, wherein said contrasting force (P) is generated by a weight (26).

4. Method according to claim 3, wherein said contrasting force (P) is generated by a weight (26) placed in the proximity of the axis (X) of the twisting spindle and of the tensioning device (10).

5. The method according to claim 1 or 2, wherein said contrasting force (P) is generated by an elastic element (42).

6. The method according to claim 1 or 2, wherein said contrasting force (P) has a value which can be regulated.

7. Tensioning device for stabilizing and regulating the tension of a thread (16) being unwound from a bobbin (18), wherein tensioning means (32) are provided to add a resistant tension (Δt) to the unwinding tension ($t_d$), said resistant tension being automatically variable in relation to the intensity of said unwinding tension ($t_d$), so that the tension ($t_2$) of the thread (16) at the exit from the tensioning device (10) is substantially constant said resistant tension (Δt) being applied by a contrasting force (P) generated by a weight (26) or an elastic element (42) which opposes said unwinding tension ($t_d$) said weight being placed in correspondence with an axis (X) of a twisting spindle and the tensioning device (10) which is varied as the thread is wrapped at a variable range wrapping angle (α), wherein said tensioning means include an arm element (12) suitable to oscillate around a rotation axis (X), in order to wind, at said variable range wrapping angle (Δ), said thread (16) on a cylindrical body (21) coaxial with said rotation axis (X); and wherein an arm element (12) is subject to the action of said unwinding tension ($t_d$) of said thread (16), increased by said resistant tension (Δt) and wherein said arm element (12) is integral with a cylindrical element (23) that rotates around said rotational axis (X) and is connected to a flexible haulage element (25) on which said contrasting force (P) is applied.

8. The device according to claim 7, wherein said haulage element (25) includes a small cable, a rope or a small belt.

9. Device according to claim 8 herein within the haulage element (25) is inserted a joint (25') that does not transmit to the weight (26) the rotating movement that affects the tensioning device (10).

10. The device according to claim 7, characterized in that said contrasting force (P) is generated by a weight (26) associated with a haulage element (25).

11. The device according to claim 7 or 8, wherein said contrasting force (P) is generated by an elastic element (42) associated with said haulage element (25).

12. The device according to claim 11, wherein said elastic element includes a flexional spring (42) connected to a cam (40) rotating on an axis parallel to said rotational axis (X), a first end (25*a*) of said haulage element (25) being integral with said cylindrical element (23), and a second end (25*b*) being integral with said cam (40).

13. The device according to claim 12, wherein that said cam (40) develops in a substantially linear mode for a certain angle (β), its radius (A1–A2) progressively increasing, and the entity of its development is substantially equal to the circumference of said cylindrical element (23).

14. The device according to claim 12 wherein said spring (42) is arranged coaxially to said cam (40) and one of its ends is fixed to said cam (40), whereas the other end is fixed to a supporting plate (45).

15. The device according to claim 7 wherein said cylindrical body (21), on which said thread (16) is suitable for being wound, is fixed to a supporting plate (45) which is immobile with respect to said bobbin (18), in the case of direct unwinding, and rotates together with a reeling machine (60) with respect to said bobbin (18), when unwinding with a reeling machine (60).

* * * * *